US011898548B2

(12) United States Patent
Meza et al.

(10) Patent No.: US 11,898,548 B2
(45) Date of Patent: Feb. 13, 2024

(54) DIAPHRAGM PUMP UTILIZING DUCKBILL VALVES, MULTI-DIRECTIONAL PORTS AND FLEXIBLE ELECTRICAL CONNECTIVITY

(71) Applicant: Flow Control LLC, Beverly, MA (US)

(72) Inventors: Humberto V. Meza, Trabuco Canyon, CA (US); Derrick T. Tran, Yorba Linda, CA (US); Bernard L Perkins, Orange, CA (US)

(73) Assignee: FLOW CONTROL LLC, Beverly, MA (US)

( * ) Notice: Subject to any disclaimer, the term of this patent is extended or adjusted under 35 U.S.C. 154(b) by 0 days.

(21) Appl. No.: 16/748,166

(22) Filed: Jan. 21, 2020

(65) Prior Publication Data

US 2020/0158105 A1 May 21, 2020

Related U.S. Application Data

(63) Continuation of application No. 14/740,577, filed on Jun. 16, 2015, now abandoned.
(Continued)

(51) Int. Cl.
*F04B 45/04* (2006.01)
*F04C 15/06* (2006.01)
(Continued)

(52) U.S. Cl.
CPC ..... *F04B 43/026* (2013.01); *F04B 15/02* (2013.01); *F04B 43/04* (2013.01); *F04B 53/10* (2013.01); *F04B 53/1057* (2013.01); *F04B 53/16* (2013.01)

(58) Field of Classification Search
CPC ..... F04B 53/10; F04B 53/1057; F04B 43/02; F04B 43/026; F04B 45/04; F04B 53/16; F04B 15/02; F04C 15/06
See application file for complete search history.

(56) References Cited

U.S. PATENT DOCUMENTS 2,221,071 A * 11/1940 Barfod ..... F02M 59/14 417/395
2,764,097 A 9/1956 Browne
(Continued)

FOREIGN PATENT DOCUMENTS

CN 2140463 8/1993
CN 1099103 2/1995
(Continued)

OTHER PUBLICATIONS

"Another Pump Rebuild—Henderson Mk V Bilge/Diaphragm Pump" Apr. 9, 2014 http://middlebaysailing.wordpress.com/2014/04/09/another-pump-rebuild-hendersonmk- v-bilgediaphragm-pump/ Disclosing the parts supplied for cleaning & rebuilding a bilge pump, which must pass reasonable bits of flotsam/jetsam without adverse effect. See the description of the "joker" valve, or duck-beak valve on pp. 3-4.

(Continued)

*Primary Examiner* — Philip E Stimpert
*Assistant Examiner* — Dnyanesh G Kasture
(74) *Attorney, Agent, or Firm* — Ware, Fressola, Maguire & Barber LLP

(57) ABSTRACT

Diaphragm pump features upper/lower diaphragm pumping assemblies (U/LDPAs) for pumping fluid and a manifold assembly arranged therebetween. The manifold assembly include a manifold body having an inlet with dual inlet ports and an inlet chamber to receive the fluid from a source; an inlet check valve assembly channel having an inlet duckbill check valve assembly (DCVA) arranged therein to receive the fluid from the dual inlet ports; U/LDPAs orifices having the U/LDPA arranged therein to receive the fluid from the inlet DCVA via first upper/lower manifold conduits and provide the fluid from the U/LDPAs via second upper/lower manifold conduits; an outlet check valve assembly channel
(Continued)

Pump Assembly showing another way of port fitting connection in front

Pump Assembly showing either dual inlet/outlet port fitting connection having an outlet DCVA arranged therein to receive the fluid from the U/LDPAs; and an outlet having dual outlet ports and an outlet chamber to receive the fluid from the U/LDPAs and provide the fluid from the pump to a outlet source.

8 Claims, 9 Drawing Sheets

Related U.S. Application Data

(60) Provisional application No. 62/012,526, filed on Jun. 16, 2014.

(51) Int. Cl.

| | |
|---|---|
| ***F04B 43/02*** | (2006.01) |
| ***F04B 53/10*** | (2006.01) |
| ***F04B 53/16*** | (2006.01) |
| ***F04B 15/02*** | (2006.01) |
| ***F04B 43/04*** | (2006.01) |

(56) References Cited

U.S. PATENT DOCUMENTS

| | | | | |
|---|---|---|---|---|
| 2,922,854 | A | 1/1960 | Nielsen | |
| 3,775,030 | A * | 11/1973 | Wanner | F04B 1/14 417/388 |
| 4,478,560 | A * | 10/1984 | Rupp | F01L 23/00 417/393 |
| 4,583,920 | A | 4/1986 | Lindner | |
| 4,597,721 | A * | 7/1986 | Santefort | F04B 43/026 417/393 |
| 4,605,273 | A | 8/1986 | Horton | |
| 4,936,753 | A | 6/1990 | Kozumplik, Jr. et al. | |
| 5,071,370 | A | 12/1991 | Kochan, Jr. | |
| 5,304,073 | A | 4/1994 | Golobay et al. | |
| 5,332,372 | A * | 7/1994 | Reynolds | F04B 43/009 417/383 |
| 5,391,060 | A * | 2/1995 | Kozumplik, Jr. | F04B 9/135 417/389 |
| 5,848,878 | A | 12/1998 | Conti et al. | |
| 5,902,096 | A | 5/1999 | Behringer et al. | |
| 6,234,823 | B1 | 5/2001 | Fuess | |
| 6,635,183 | B2 | 10/2003 | Gibson | |
| 6,863,574 | B1 | 3/2005 | Bosch | |
| 7,156,614 | B2 | 1/2007 | Racer et al. | |
| 7,287,964 | B2 | 10/2007 | Sanwald | |
| 7,390,175 | B2 | 6/2008 | Maki et al. | |
| 7,690,342 | B2 | 4/2010 | Gliniecki et al. | |
| 8,151,885 | B2 | 4/2012 | Bull et al. | |
| 8,414,273 | B2 | 4/2013 | Williams | |
| 8,556,910 | B2 | 10/2013 | Truckai et al. | |
| 8,596,992 | B2 * | 12/2013 | DeDecker | F04B 27/0536 417/419 |
| 8,690,554 | B2 | 4/2014 | Villagomez et al. | |
| 2006/0159565 | A1 * | 7/2006 | Sanwald | B05B 7/1459 417/395 |
| 2006/0283320 | A1 * | 12/2006 | Lee | F04B 1/2064 91/499 |
| 2009/0092507 | A1 * | 4/2009 | Ramirez, Jr. | F04B 43/1253 417/410.1 |
| 2010/0133297 | A1 | 6/2010 | Arett et al. | |
| 2011/0002802 | A1 | 1/2011 | Capone et al. | |
| 2011/0139825 | A1 | 6/2011 | Houghton | |
| 2011/0171045 | A1 * | 7/2011 | Gilpatrick | F04B 9/042 417/273 |
| 2012/0285540 | A1 | 11/2012 | Morii et al. | |
| 2013/0017110 | A1 * | 1/2013 | Villagomez | F04B 43/02 417/559 |
| 2013/0094983 | A1 | 4/2013 | Pelfrey | |
| 2013/0184641 | A1 | 7/2013 | Li | |
| 2013/0331823 | A1 | 12/2013 | Askem et al. | |
| 2015/0217312 | A1 * | 8/2015 | Hines | B05B 9/0413 222/333 |
| 2015/0226192 | A1 * | 8/2015 | Hines | F04B 17/044 417/413.1 |

FOREIGN PATENT DOCUMENTS

| | | |
|---|---|---|
| CN | 1227314 | 9/1999 |
| CN | 1517548 | 8/2004 |
| CN | 103244405 | 8/2013 |
| EP | 0286404 | 7/1991 |
| EP | 0524820 | 1/1993 |
| EP | 0713009 | 5/1996 |
| EP | 1437178 | 7/2004 |
| JP | 1998054372 A | 6/1996 |
| JP | 2004210544 A | 7/2004 |
| RU | 2068118 | 10/1996 |
| RU | 2101567 | 1/1998 |

OTHER PUBLICATIONS

BPE Burt, "ARO Diaphragm Pumps-66605X-XXX" 1/2 Classic Style Non-Metallic Ball: 13 GPM (49.2 LPM) Duckbill: 10 GPM (37.9 LPM) http://www.aroexp.com/aro-diaphragm-compact-pumps/aro-1-2-classic-stylenon-metallic/aro-66605x-pumps.php#.U6HbGyiorqw Disclosing a treatise offering an explanation for lack of conventions, with a brief history and links to sources of adapters and "universal plug".

"Pump Control Circuit for Automatic Tank Emptying—Cynergy3" www.cynergy3.com/ . . . /How%20to%20create%20a%20pump%20control. http://www.cynergy3.com/blog/how-create-pump-control-circuit-automaticallyempty-tank Disclosing pump passing particles through duckbill valve (2nd page).

English language Abstract of EP1437178.
English language Abstract of CN2140463Y.
English language Abstract of CN1517548A.
English language Abstract of RU2068118C1.
English language Abstract of RU2101567C1.
English language Abstract of CN103244405A.
English language Abstract of CN1227314A.
English language Abstract of CN1099103A.
English language Abstract and translation of JP2004210544A.
Relevant document US5848878B in lieu of JP1998054372A.

* cited by examiner

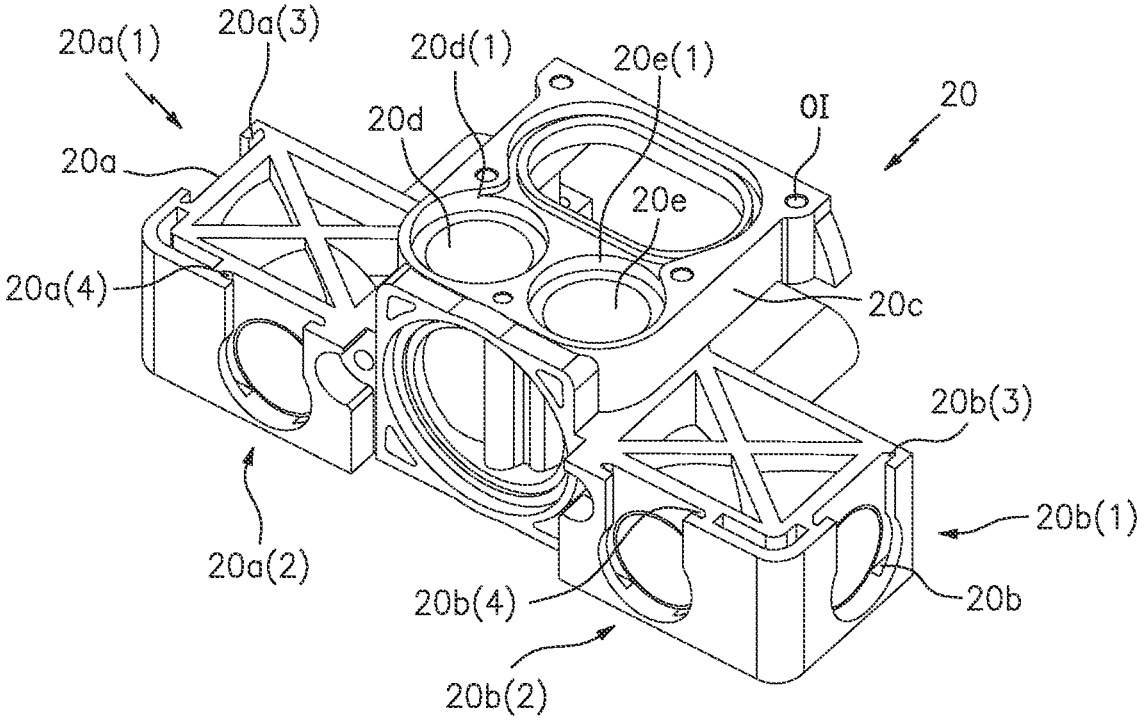
*FIG. 7*: Pump Housing with Multi-Ports
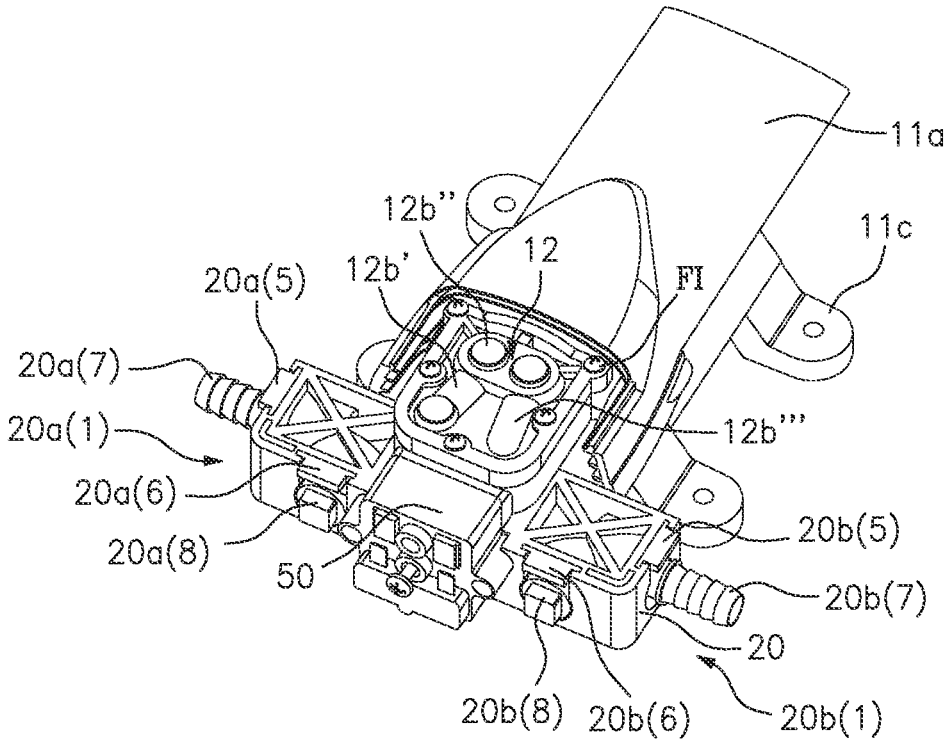
*FIG. 7A*: Pump Addembly showing standard port fitting connection left/right

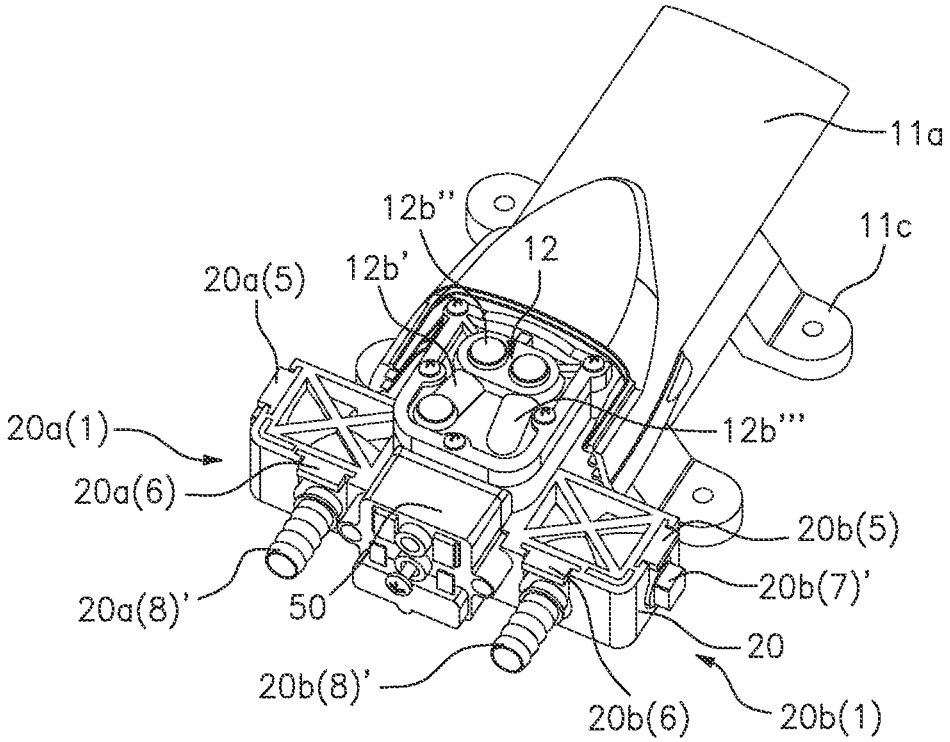
*FIG. 7B*: Pump Assembly showing another way of port fitting connection in front
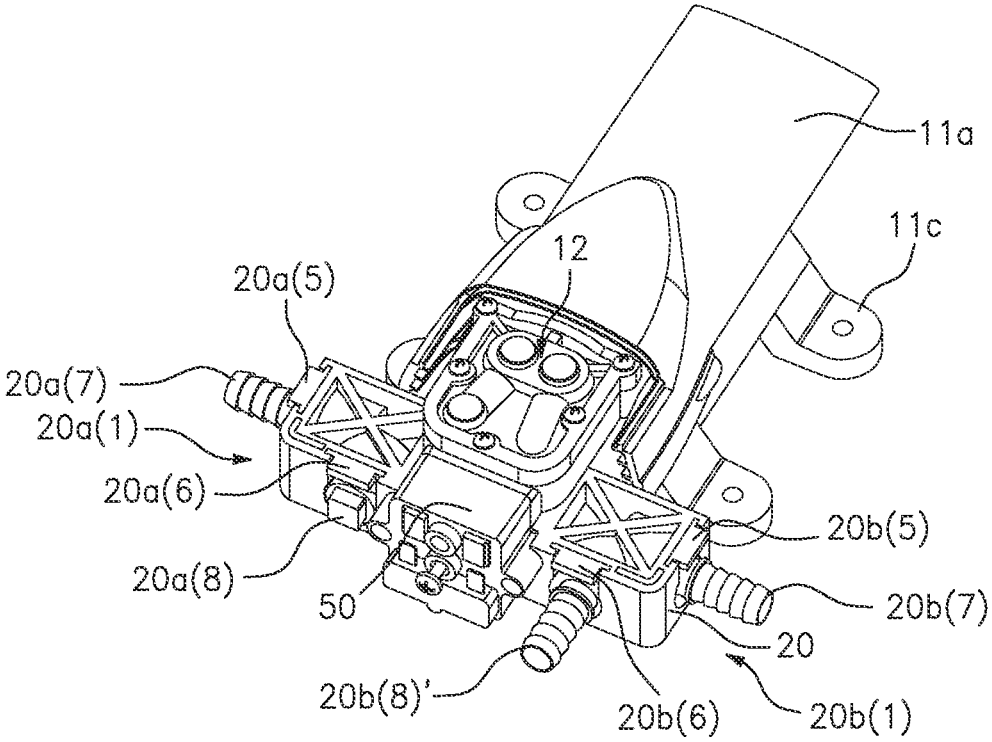
*FIG. 7C*: Pump Assembly showing either dual inlet/outlet port fitting connection

DIAPHRAGM PUMP UTILIZING DUCKBILL VALVES, MULTI-DIRECTIONAL PORTS AND FLEXIBLE ELECTRICAL CONNECTIVITY

CROSS-REFERENCE TO RELATED APPLICATIONS

This application is a continuation application of, and claims benefit to, U.S. patent application Ser. No. 14/740,577, filed 16 Jun. 2015, which claims benefit to provisional patent application Ser. No. 62/012,526, filed 16 Jun. 2014, which are all hereby incorporated by reference in its entirety.

BACKGROUND OF THE INVENTION

1. Field of the Invention

The present invention relates to a pump for providing fluid and particulate; and more particularly relates to a diaphragm pump having a manifold assembly for pumping viscous fluid having solids and particulates.

2. Brief Description of Related Art

FIG. 1 shows a diaphragm pump having a pump manifold with spring-loaded or 'umbrella' valves, which is known in the art. In FIG. 1, the spring is arranged between upper and lower umbrella valves. Pump are also known in the art having fixed wiring. Shortcomings of the known diaphragm pump configurations may include one or more of the following:

a. Valve Types—Spring loaded and umbrella style valves are limited to pumping low viscosity and "debris free" fluids. Liquids with high viscosity and/or particulates cause priming and performance issues on existing valve types.
   i. Umbrella type valves—Consistent with that shown in FIG. 1, these umbrella type valves typically easily clog due to particulates in the fluid. When the umbrella type valves are clogged/fouled, they will not seal properly and this prevents the pump from priming and building pressure.
   ii. Spring loaded valves—Consistent with that shown in FIG. 1, the solids in the liquid being pumped typically become entangled in the spring mechanism and prevent the valve from opening and closing.
b. Pumps having fixed wiring do not have the flexibility to quick connect/disconnect for servicing. Typical pumps have fixed wiring extending from the motor. If the user requires a connector that must be attached to the existing wires.
c. Most pumps in the marketplace today usually have 1 inlet and 1 discharge ports from the left and right side of pump head. Therefore, they are limited to only 1 way of connecting the inlet/outlet fittings.

In view of this, there is a need in the industry for a pump that solves these shortcomings in the pumps that are known in art.

SUMMARY OF THE INVENTION

According to some embodiments, the present invention may include, or take the form of, a pump featuring a new and unique combination of upper and lower diaphragm pumping assemblies together with a manifold assembly.

The upper and lower diaphragm pumping assemblies may be configured for pumping fluid through the pump.

The manifold assembly may be configured or arranged between the upper and lower diaphragm pumping assemblies.

The manifold assembly may include or be configured with a combination of a manifold body, an inlet check valve assembly channel, upper and lower diaphragm pumping assembly orifices, an outlet check valve assembly channel and an outlet.

The manifold body may be configured with an inlet having at least one inlet port and an inlet chamber to receive the fluid from at least one fluid source.

The inlet check valve assembly channel may include an inlet duckbill check valve assembly arranged therein to receive the fluid from the at least one inlet port.

The upper and lower diaphragm pumping assembly orifices may include the upper and lower diaphragm pumping assemblies arranged therein to receive the fluid from the inlet duckbill check valve assembly via first upper and lower manifold conduits and provide the fluid from the upper and lower diaphragm pumping assemblies via second upper and lower manifold conduits.

The outlet check valve assembly channel may include an outlet duckbill check valve assembly arranged therein to receive the fluid from the upper and lower diaphragm pumping assemblies.

The outlet may include at least one outlet port and an outlet chamber to receive the fluid from the upper and lower diaphragm pumping assemblies and provide the fluid from the pump to at least one fluid outlet source.

The present invention may include one or more of the following features:

The at least one inlet port may include dual inlet ports configured to receive inlet port fitting connections, and the at least one outlet port may include dual outlet ports configured to receive outlet port fitting connections.

The inlet duckbill check valve assembly may include two duckbill check valves, and the outlet duckbill check valve assembly comprises two duckbill check valves.

The manifold assembly may include two manifold assembly covers or plates attached to upper and lower surfaces of the manifold body and configured with the first and second upper and lower manifold conduits for providing fluid from the inlet check valve assembly channel to the outlet check valve assembly channel.

The manifold body may include, or take the form of, a plastic injection molded integral structure.

The dual inlet ports may be configured or oriented orthogonal to one another; and the dual outlet ports are configured or oriented orthogonal to one another.

The dual inlet ports and the inlet chamber may be configured to receive the fluid from two fluid sources for mixing together in the inlet chamber; and the dual outlet ports and the outlet chamber may be configured to provide a mixed fluid to the at least one fluid outlet source, including where the at least one fluid outlet source includes two fluid outlet sources.

The inlet duckbill check valve assembly and the outlet duckbill check valve assembly may be configured to process a particle medium having up to 4 millimeters (mm) in diameter.

Either the dual inlet ports, or the dual outlet ports, or both the dual inlet ports and the dual outlet ports, may be configured to receive different port fitting connections, including where the different port fitting connections include a port fitting connection that allows the passage of the fluid either to or from the respective port, and a corresponding port fitting connection that does not allow the passage of the fluid either to or from the respective port.

Advantages of the present invention may include one or more of the following:

a. Capability to pump high viscosity fluids.
b. Capable of handling solids and particulates in the fluid being pumped.
c. Reinforced duckbills prevent the check valve from collapsing during operations that generate higher back pressures.
d. Flexible wiring options for quick connect/disconnect for servicing allowing easier installation, servicing and general maintenance.
e. Multiple port pump housing or assembly that allows for flexibility of port fitting connections and dispensing/mixing.

In effect, the pump having the aforementioned diaphragm pumping and manifold assemblies according to the present invention solves problems that have plagued the prior art pump shown in FIG. 1, and provides an important contribution to the state of the art.

BRIEF DESCRIPTION OF THE DRAWING

The drawing, which are not necessarily drawn to scale, includes the following Figures:

FIG. 7 shows a top perspective view of a pump housing with multi-ports including inlet ports and outlet ports, according to other embodiments of the present invention.

FIG. 7(A) shows a top perspective view of part of a pump having a pump assembly with the pump housing in FIG. 7 configured with inlet/outlet port fitting connections extending in left/right directions transverse to the longitudinal axis of the pump, according to other embodiments of the present invention.

FIG. 7(B) shows a top perspective view of part of a pump having a pump assembly with the pump housing in FIG. 7 configured with inlet/outlet port fitting connections extending in a front direction along the longitudinal axis of the pump, according to other embodiments of the present invention.

FIG. 7(C) shows a top perspective view of part of a pump having a pump assembly with the pump housing in FIG. 7 configured with inlet/outlet port fitting connections extending in the left/right directions and a dual outlet port fitting connection extending in a left/right direction and a front direction, according to other embodiments of the present invention.

DETAILED DESCRIPTION OF THE INVENTION

FIGS. 2-8: The Dual Diaphragm and Manifold Assembly

Figure 5:
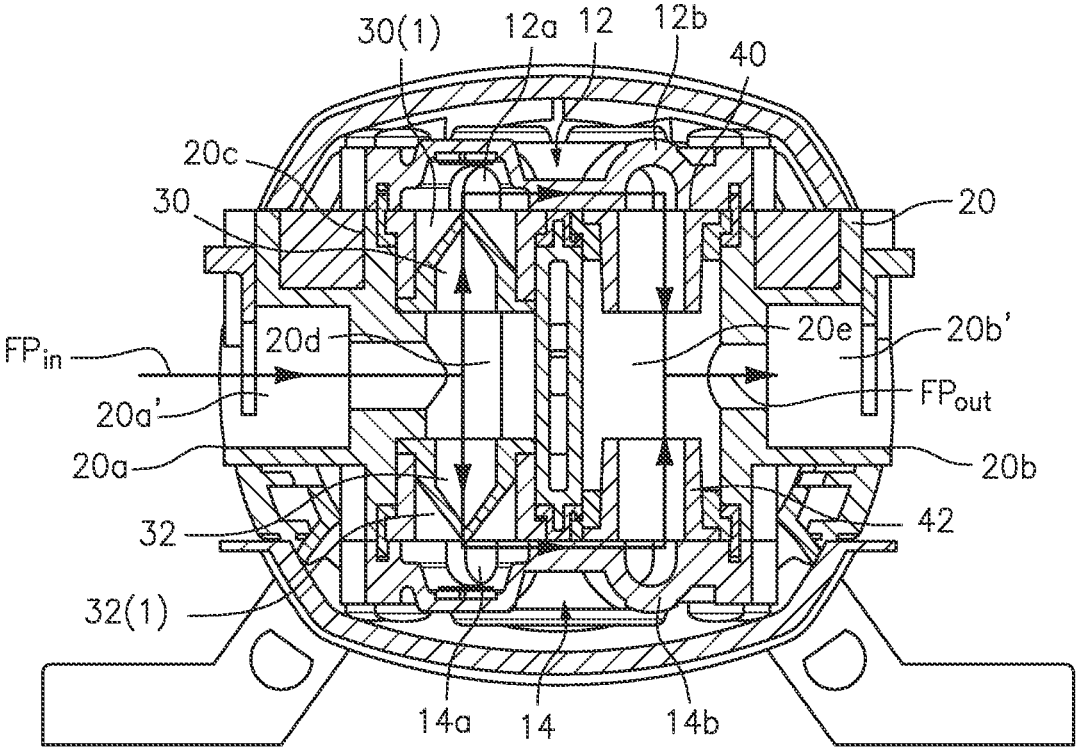
FIG. 5 shows a front-to-back cross-sectional view of the pump in FIG. 2 along lines and arrows 5-5, according to some embodiments of the present invention.
Figure 6:
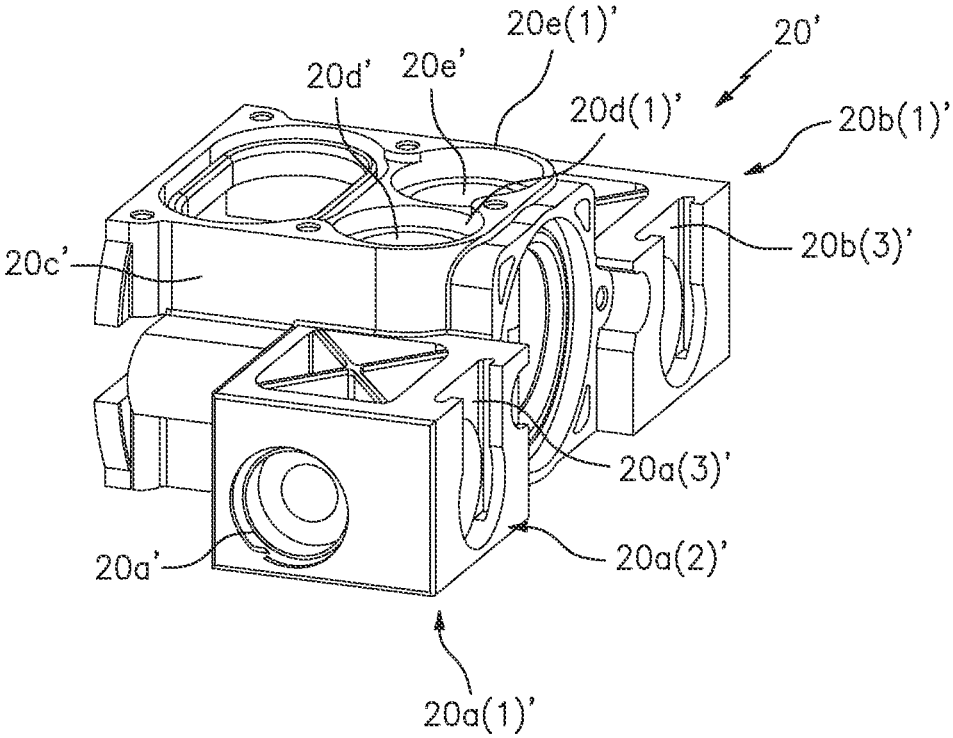
FIG. 6 shows a top perspective view of a pump housing with multi-ports, including inlet ports and outlet ports, according to some embodiments of the present invention.
Figure 8:
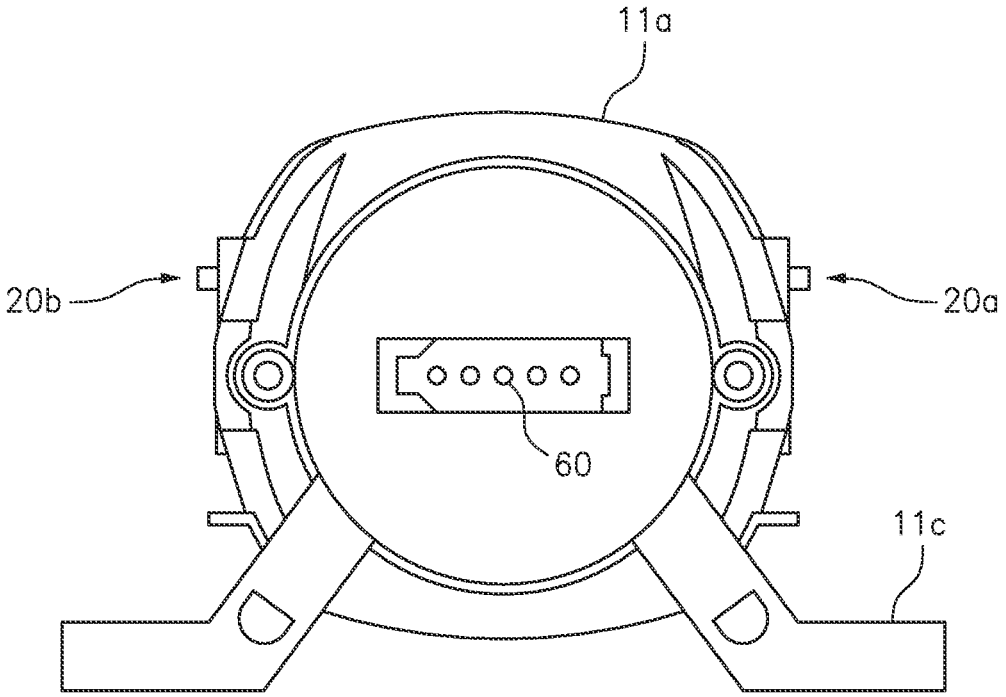
FIG. 8 shows a back-to-front cross-sectional view of the pump in FIG. 2 along lines and arrows 8-8, according to some embodiments of the present invention.

FIGS. 2-8 show a dual diaphragm pump generally indicated as 10, according to some embodiments of the present invention. FIGS. 1-5 show the dual diaphragm pump generally indicated as 10 having a single inlet/outlet configuration. In contrast, FIGS. 6-8 show configurations for a dual diaphragm pump having a multiple inlet/outlet configuration. In either case, the dual diaphragm pump may be configured with a multipart pump housing, e.g., having a motor housing 11*a* and a removable front cover 11*b*, and may also include a pump stand or mount 11*c*. FIG. 2A shows a motor 13 and a motor shaft/diaphragm actuator assembly 15 arranged in the multipart pump housing, which couples to upper and lower diaphragm pumping assemblies generally indicated as 12, 14 (see FIGS. 7A, 7B and 7C), e.g., that cooperate consistent with that described below. FIGS. 7A, 7B, 7C also shows the dual diaphragm pump configured with a pressure sensor or switch module 50 (see also FIG. 9B) that senses the pressure of the fluid being pumped, and provides a suitable pressure sensing signal containing information about the pressure sensed. Pressure sensors and/or switches are known in the art, and the scope of the invention is not intended to be limited to any particular type or kind thereof either now known or later developed in the future. In FIGS. 7A, 7B and 7C, the front pump housing for covering the configuration of the multiport manifold assembly is not shown, e.g., which is analogous to element 11*b* in FIGS. 1-5. The scope of the invention is not intended to be limited to how the multipart pump housing may be configured, combined or assembled together, etc., e.g., including the number of discrete parts in the configuration, combination or assembly.

Moreover, FIGS. 2 through 4A and 8 show that the dual diaphragm pump may also be configured with a quick connector 60 (see also FIG. 9B) for coupling to a corresponding connector for providing electrical power to the pump, e.g., including from a wall mounted transformer (not shown). The quick connector 60 configured on the pump wiring allows a user to specify the connector they require, and the wiring from their system would be configured with a suitable mating connector and plug for coupling directly into the pump. This quick connector configuration 60 allows for a quick and safe removal of a pump for a power source for the purpose of servicing. Flexible wiring options may also be configured that also allow for remote mounting of signal input/output devices and a power input.

The Manifold Assembly 20, 20'

The diaphragm pump may include a manifold assembly like elements 20 and 20', e.g., as shown in FIGS. 6 and 7.

By way of example, FIG. 7 shows the manifold assembly 20 equipped with internal input and output duckbill valves 30, 32, 40, 42 that allow for the passing of solids and particulate in the liquid being pumped without fouling or clogging the internal duckbill valves 30, 32, 40, 42. The integration of the internal duckbill valves 30, 32, 40, 42 allows the diaphragm pump 10 to handle higher viscosity fluids with less restriction and is capable of passing a larger particle medium of sizes up to 4 millimeters (mm) in diameter, especially when compared to the prior art pump shown in FIG. 1. The internal input and output duckbill valves 30, 32, 40, 42 can be reinforced with an internal support to prevent the respective valve from collapsing in applications that will generate higher back pressures during operation or when the pump is not running, e.g., consistent with that disclosed in U.S. Pat. Nos. 8,276,616 and 8,690,554, which are assigned to the assignee of the present application and hereby incorporated by reference in their entirety.

Figure 4:
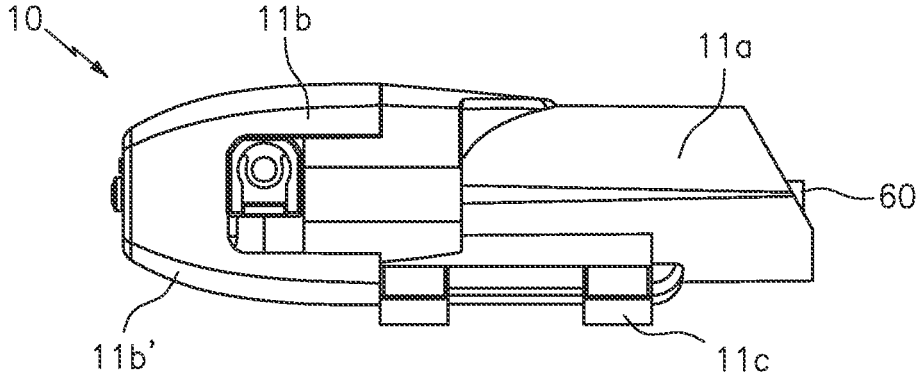
FIG. 4 shows a side view of the pump in FIG. 2, according to some embodiments of the present invention.
Figure 4A:
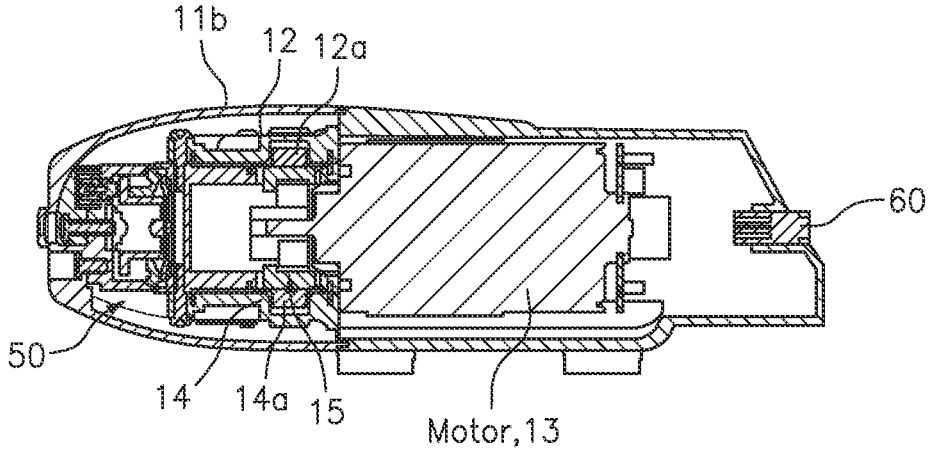
FIG. 4A shows a cross-sectional view of a left side of the pump in FIG. 2 along lines and arrows 4A-4A, according to some embodiments of the present invention.

The diaphragm pump may include the upper and lower diaphragm pumping assemblies generally indicated as 12, 14 in combination with the manifold assembly 20, e.g., as shown in FIGS. 4A and 5. By way of example, the upper and lower diaphragm pumping assemblies 12, 14 may be configured with upper and lower diaphragm 12*a*, 14*a*, and upper and lower diaphragm assembly covers or plates 12*b*, 14*b* that are respectively fastened to the manifold assembly 20, as shown. See the five (5) fasteners/screws like element f1 in FIGS. 7A, 7B and 7C, and the corresponding five (5) fastener openings like element o1 configured or formed in the manifold assembly 20 in FIG. 7. See also FIGS. 7A, 7B and 7C, which show the upper diaphragm pumping assembly 12.

In operation, the upper and lower diaphragm pumping assemblies 12, 14 may be configured for pumping fluid through the dual diaphragm pump 10. By way of example, the upper diaphragm pumping assembly 12 may be configured to draw the fluid from the inlet chamber 20*a* into the manifold assembly 20, through the upper input duckbill valve 30, through the upper output duckbill valve 40, to the outlet chamber 20*b* and from the manifold assembly 20; and the lower diaphragm pumping assembly 14 may be configured to draw the fluid from the inlet chamber 20*a* into the manifold assembly 20, through the lower input duckbill valve 32, through the lower output duckbill valve 42, to the outlet chamber 20*b* and from the manifold assembly 20, e.g., consistent with that shown in FIG. 5.

The manifold assembly 20 may be configured or arranged between the upper and lower diaphragm pumping assemblies 12, 14 and have components configured to operate as follows:

As best shown in FIGS. 5 and 7, in addition to the inlet chamber 20*a*, and the outlet chamber 20*b*, the manifold assembly 20 may also include or be configured with a combination of a one-piece integral manifold body 20*c*, an inlet check valve assembly channel 20*d* having upper diaphragm pumping assembly orifices, one such inlet orifice which is labeled 20*d* (1), and an outlet check valve assembly channel 20*e* having upper and lower diaphragm pumping assembly orifices, one such outlet orifice which is labeled 20*e* (1).

The inlet 20*a* may be configured with dual inlet ports generally indicated as 20*a* (1), 20*a* (2) to receive the fluid from at least one fluid source (not shown). The dual inlet ports 20*a* (1), 20*a* (2) may be configured with inlet port channels 20*a* (3), 20*a* (4) to slidably receive inlet fitting couplers 20*a* (5), 20*a* (6) that couple inlet fittings 20*a* (7), 20*a* (8) to the dual inlet ports 20*a* (1), 20*a* (2) of the manifold assembly 20.

The inlet check valve assembly channel 20*d* may include an inlet duckbill check valve assembly arranged therein that may include the inlet duckbill check valve 30, 32, as well as one or more other inlet duckbill check valve assembly components like valve receiving members 30(1), 32(1), and internal supports (not shown) to prevent the valve from collapsing in applications that will generate higher back pressures during operation or when the pump is not running, e.g., consistent with that disclosed in U.S. Pat. Nos. 8,276,616 and 8,690,554.

By way of example, the manifold body 20*c* may include, or take the form of, a plastic injection molded integral structure, although embodiments are envisioned using other structures or configuration both now known and later developed in the future within the spirit on the underlying invention.

FIG. 5 shows a flowpath of fluid through the dual diaphragm pump, including an input partway of a fluid flow path $FP_{in}$ for fluid flowing into the inlet 20*a*, an internal part for fluid flowing through the inlet check valve assembly channel 20*d*, through the upper and lower diaphragm pumping assemblies 12, 14, and through the outlet check valve assembly channel 20*e*, and an output flowpath $FP_{out}$ for fluid flowing from the outlet 20*b*, e.g., consistent with that set forth herein.

The upper diaphragm pumping assembly inlet orifice 20*d* (1) may be configured to be in fluidic communication with the upper diaphragm pumping assembly like element 12 arranged therein to receive the fluid from the inlet duckbill check valve 30, as well as one or more other inlet duckbill check valve assembly components like valve receiving members 30(1), provide (i.e. pump) the fluid via upper manifold conduits indicated by reference label 12*b*', 12*b*", 12'", to the upper diaphragm pumping assembly orifice 20*e* (1). In operation, and as a person skilled in the art would appreciate, the motor shaft/diaphragm actuator assembly 15 together with the diaphragm 12*a* may be configured in order to provide the liquid from the upper manifold conduit 12*b*', through the upper manifold conduits 12*b*", and to the upper manifold conduit 12'". The upper diaphragm pumping assembly outlet orifice 20*e* (1) may be configured to be in fluidic communication with the outlet check valve assembly channel 20*e*, for providing fluid to the outlet duckbill check valve 40, as well as one or more other outlet duckbill check valve assembly components like valve receiving members 40(1), and provide (i.e. pump) the fluid to the outlet 20*b*.

As a person skilled in the art would appreciate, the lower diaphragm pumping assembly 14 is configured to operate in a similar manner to the upper diaphragm pumping assembly 12.

The outlet 20*b* may be configured with dual outlet ports generally indicated as 20*b* (1), 20*b* (2) to provide the fluid the pump 10 to at least one fluid outlet source (not shown). The dual outlet ports 20*b* (1), 20*b* (2) may be configured with outlet port channels 20*b* (3), 20*b* (4) to slidably receive outlet fitting couplers 20*b* (5), 20*b* (6) that couple outlet fittings 20*b* (7), 20*b* (8) to the dual outlet ports 20*b* (1), 20*b* (2) of the manifold assembly 20.

FIGS. 7, 7A, 7B and 7C

FIGS. 7, 7A, 7B and 7C show multi-directional port configurations. In effect, the present invention allows for many different inlet/outlet port connections which provide for flexibility in certain tight, fixed spaces. By way of example, with the dual inlet ports, mixing of two (2) different fluids may be made possible as well; and the dual discharge ports allow for two (2) dispensing valves/faucets.

As shown, the dual inlet ports 20*a* (1), 20*a* (2) may be configured or oriented orthogonal to one another; and the dual outlet ports 20*b* (1), 20*b* (2) are configured or oriented orthogonal to one another, although embodiments are envisioned using other types or kinds of geometric relationship between the dual inlet ports, the dual output ports, or both.

The dual inlet ports 20*a* (1), 20*a* (2) and the inlet chamber 20*a* may be configured to receive the fluid from two fluid sources (not shown) for mixing together in the inlet chamber 20*a*; and the dual outlet ports 20*b* (1), 20*b* (2) and the outlet chamber 20*b* are configured to provide a mixed fluid to at least one fluid outlet source (not shown).

The inlet duckbill check valve assembly 20*d* and the outlet duckbill check valve assembly 20*e* may be configured to process a particle medium having up to 4 millimeters (mm) in diameter.

Either the dual inlet ports 20*a* (1), 20*a* (2), or the dual outlet ports 20*b* (1), 20*b* (2), or both the dual inlet ports 20*a* (1), 20*a* (2) and the dual outlet ports 20*b* (1), 20*b* (2), may be configured to receive different port fitting connections.

Figure 1:
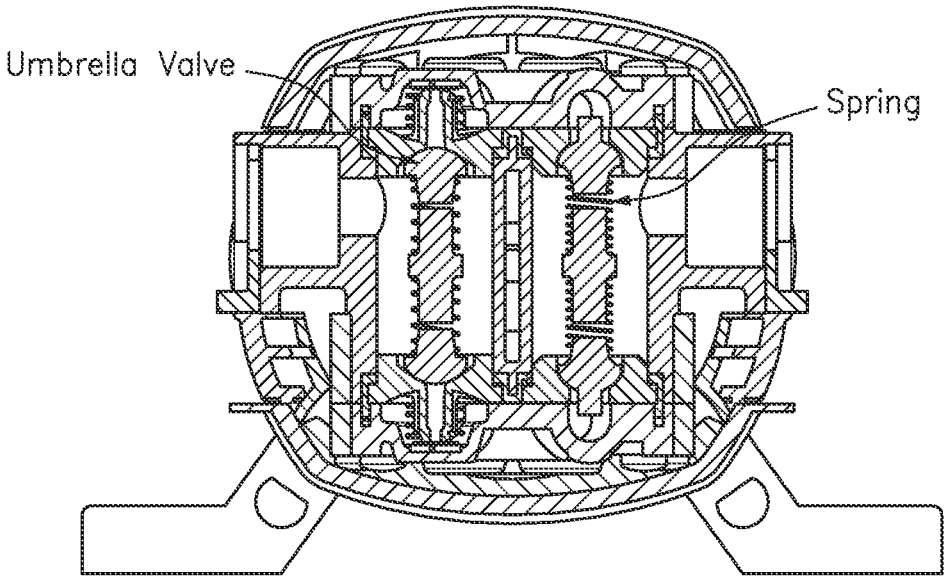
FIG. 1 (PRIOR ART)
FIG. 1 shows a front-to-back cross-sectional view of a pump that is known in the art.
Figure 2:
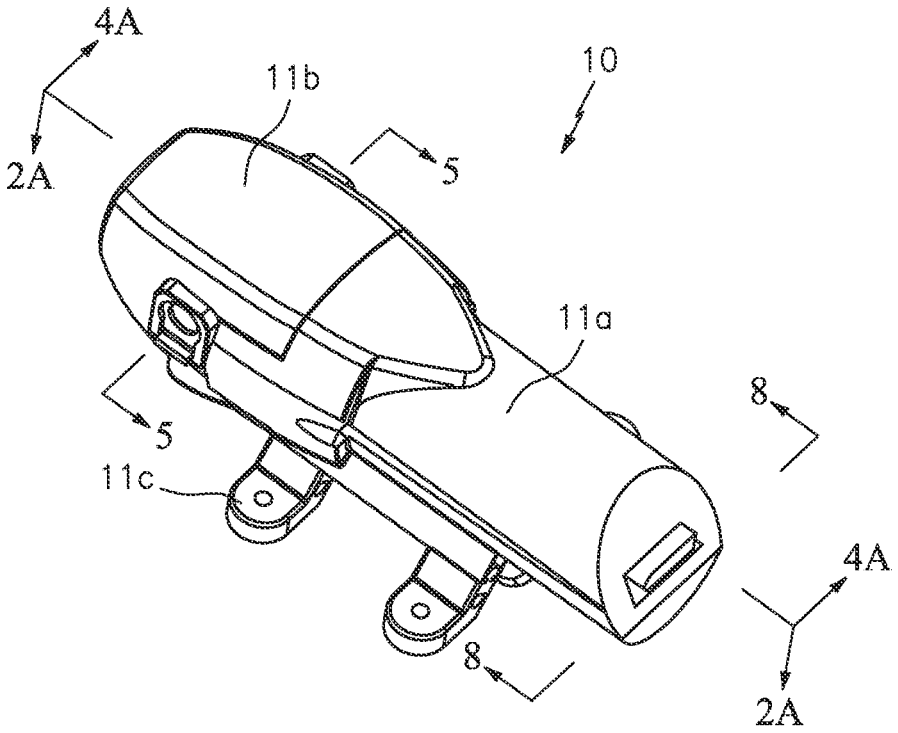
FIG. 2 shows a perspective view of a pump having a single inlet and outlet, according to some embodiments of the present invention.
Figure 2A:
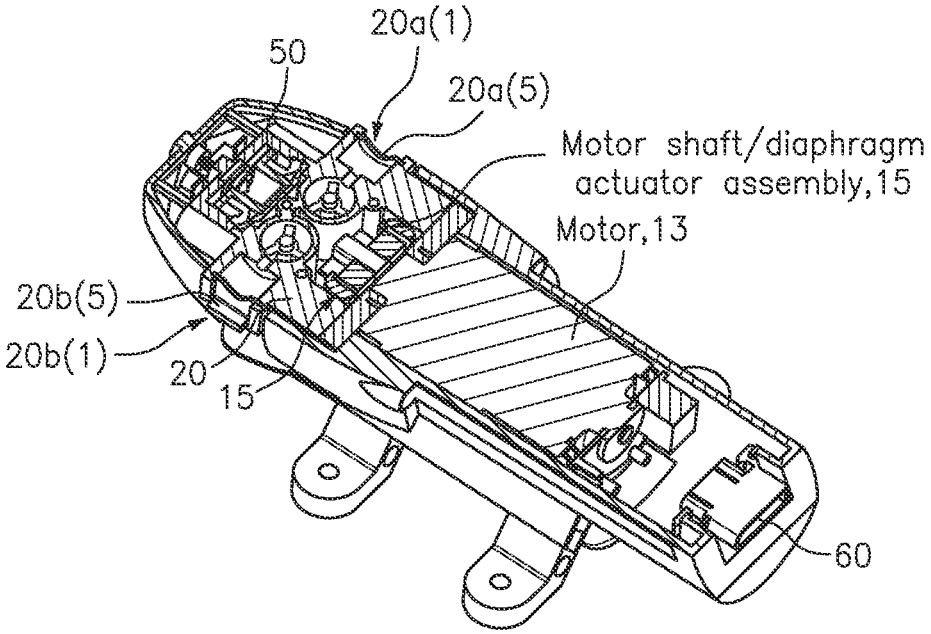
FIG. 2A shows a cross-sectional view of a lower half of the pump in FIG. 2 along lines and arrows 2A-2A, according to some embodiments of the present invention.
Figure 3:
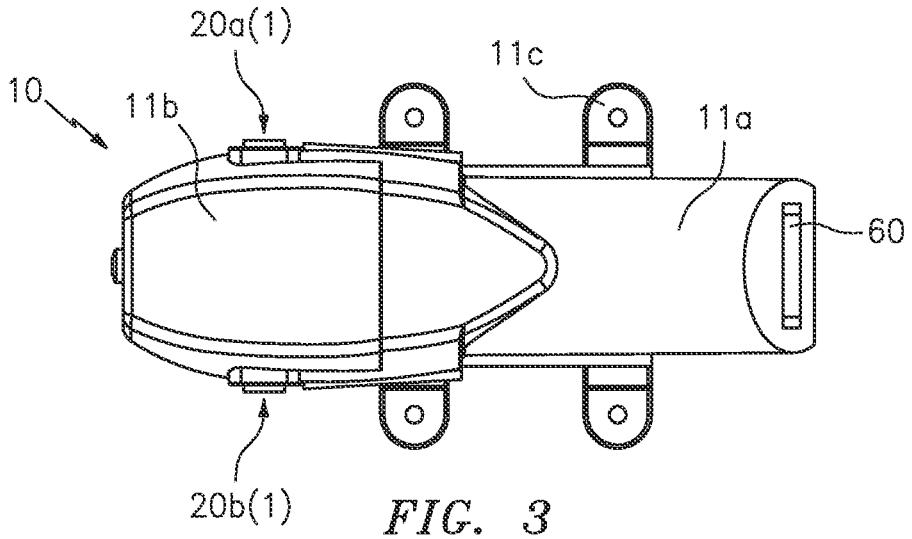
FIG. 3 shows a top down plan view of the pump in FIG. 2, according to some embodiments of the present invention.

It is noted that in FIGS. 7A, 7B and 7C the part of the pump shown does not include, by way of example, the front pump housing analogous to element 11*b* in FIG. 2. A person skilled in the art would appreciate how to configured such a front pump housing without undue experimentation, e.g., based on that disclosed herein.

FIG. 6 shows an alternative embodiment of the manifold assembly 20', having parts and components thereof labeled similar to the parts and components of the manifold assembly 20 in FIG. 7 with the additional of a single quote "'". The manifold assembly 20' is configured to operate in a manner substantially similar to the manifold assembly 20 (FIG. 7).

Figure 9A:
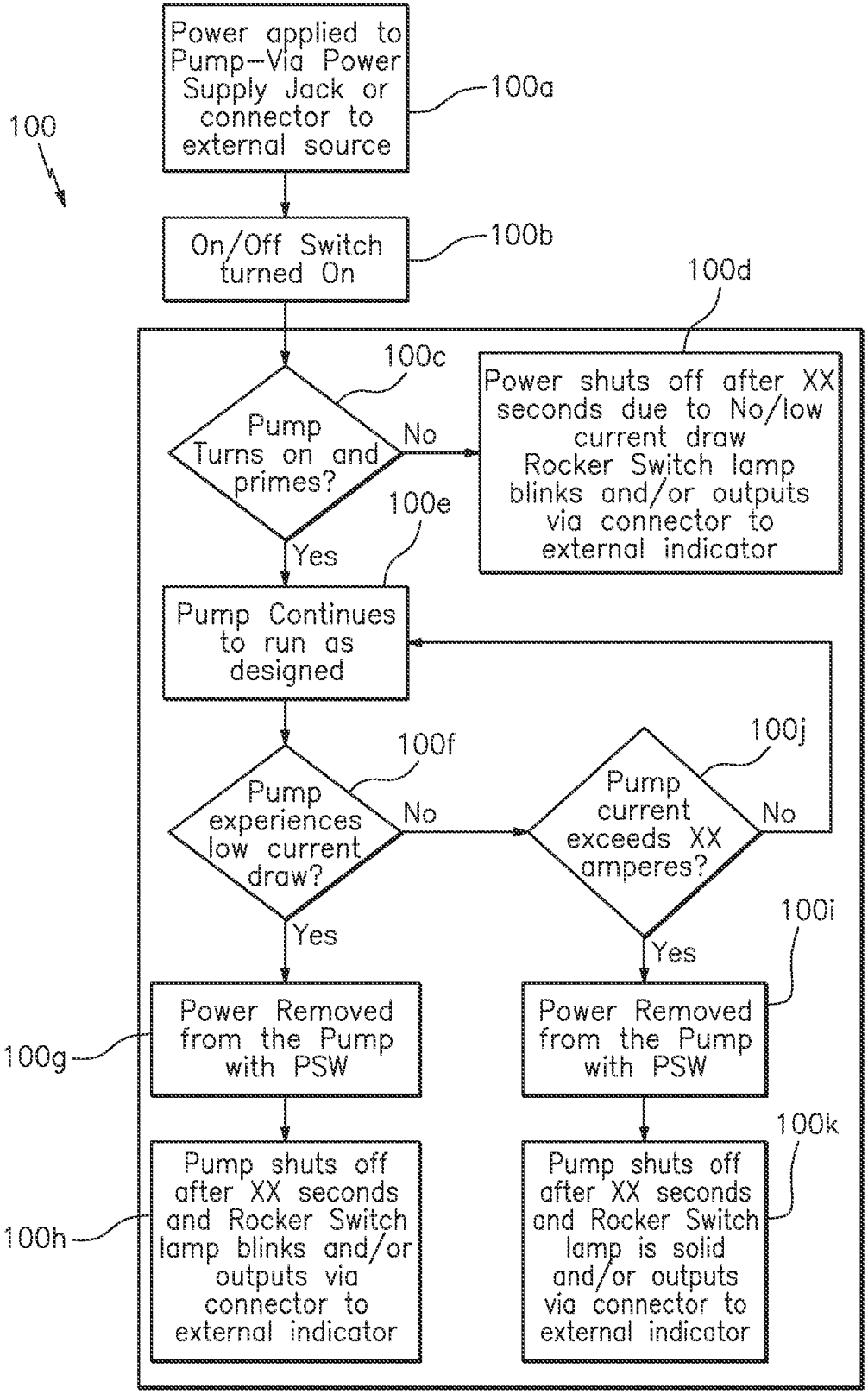
FIG. 9A shows a flowchart having steps for implementing control functionality for operating a pump arrangement or configuration like that shown in FIG. 9B, according to some embodiments of the present invention.
Figure 9B:
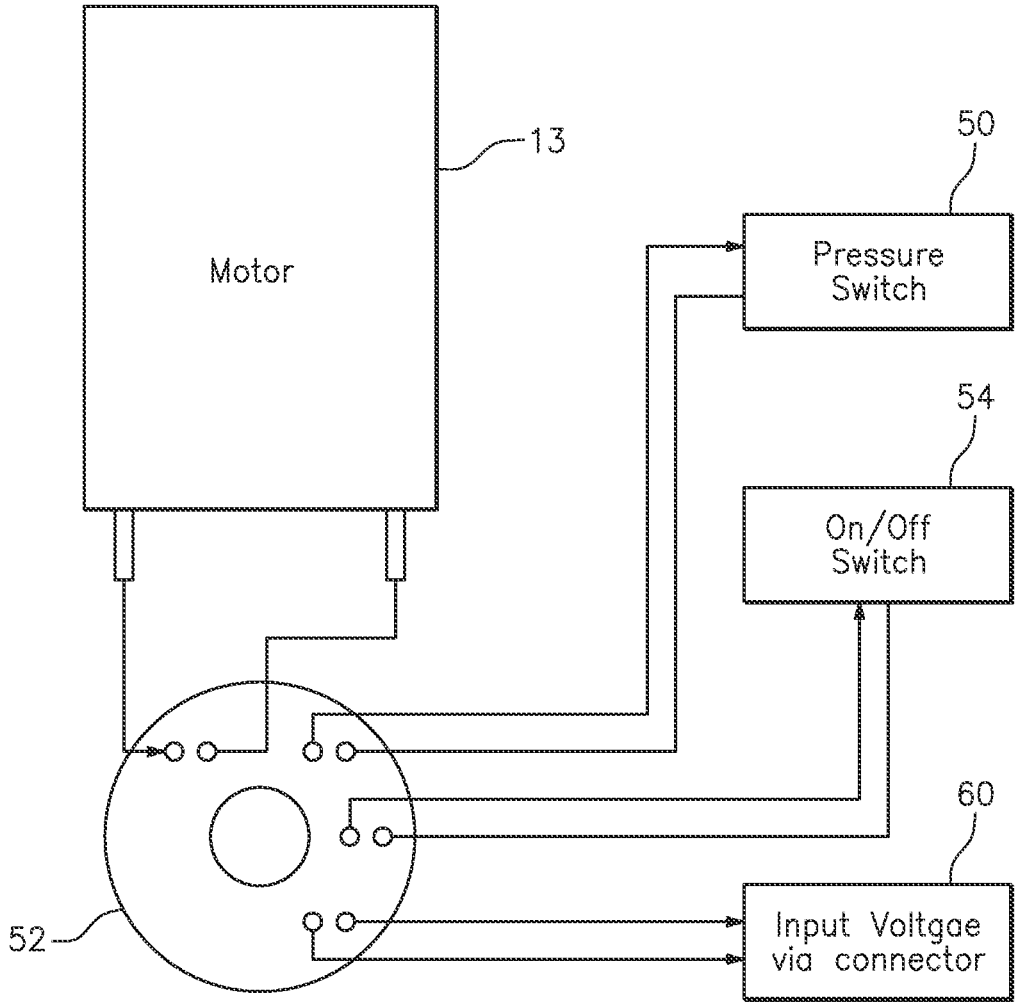
FIG. 9B shows part of a pump arrangement or configuration having a motor coupled via a printed circuit board assembly (PCBA) to a pressure switch, an on/off switch and a connector for receiving an input, for operating a pump, according to some embodiments of the present invention.

FIGS. 9A and 9B: The Controller

FIG. 9A shows a flowchart generally indicated as 100 having steps 100*a* through 100*k* for implementing control functionality according to the present invention for operating a pump, e.g., having at least some combination of the components shown in FIG. 9B, consistent with that set forth herein.

Controller 52—The electronics controller may include, or take the form of, an electronic PCBA 52, e.g., that may be internal to the pump, as shown in FIG. 9B.

i. Steps 100*a* and 100*b*: Power may be applied to the pump via a power supply jack or an integral connector 60, which allows for direct power to the pump via the end user's source or from a wall mount transformer (not shown), so the On/Off switch 54 can be turned On.

ii. Steps 100*c* and 100*d*: The control circuit 52 then applies power to the motor 13 and allows a pre-designated time for priming. If the pump exceeds that time and there is a low/no current draw condition, then the control circuit 52 shuts the power off. The control circuit 52 then sends a signal indicating that the pump has shut down due to a run dry/no power condition. By way of example, the signal may take the form of an audio or visual alarm, as well as a wireless signal provided to a remote location, including a wifi signal transferred via the Internet to a remote (e.g., off site) access point.

iii. Steps 100*d*, 100*e*, 100*f*: If the pump primes and is running, then the control circuit 52 monitors the current draw on the pump, and if the pump unit's current draw drops beneath a designated current range, whether by the fluid being pumped being exhausted or by some other issue, then the control circuit 52 will remove power to the motor 13. The control circuit 52 then sends a signal indicating that the pump has shut down due to a run dry/no power condition or an out-of-product being dispensed condition.

iv. Steps 100*h*, 100*i*, 100*j*: If the pump experience a high current draw, e.g., exceeding a pre-designated range, then the control circuit 52 will remove power to the motor 13 and then sends a signal indicating that the pump has shut down due to an over-current condition.

v. By way of further example, if the power to the circuit board 52 should be removed by the pressure switch 50, e.g., due to an outlet (not shown) being shut off, then the control circuit 52 may be configured to remove power form the pump until the pressure is relieved at which time the control circuit 52 may be configured to automatically turn the pump back on and supply fluid.

vi. By way of further example, if the pump runs continuously for a specified period of time, then the circuit board 52 may be configured to remove the power from the motor and sends a signal indicating the pump has shut down due to a continuous running or time-out condition.

vii. By way of further example, the control circuit 52 may also be configured to precisely control the dispense amount and flow rate, e.g., by controlling the time and/or varying the voltage to the motor 13 using a pulse wave modulation (PWM) technique, or other method of motor speed control, including techniques both known in the art or later developed in the future.

viii. By way of further example, the control circuit 52 may also be used for storing, communicating, and/or remotely adjusting the pump operating parameters/settings, pump performance profiles with various fluids and media, error codes, flow rate, and dispensed quantity information, power consumption, etc.

Possible Applications

Food and Beverage dispensing/processing, Fluid and chemical transfer and mixing, any application that may require moving liquid with high viscosity, particulates and/or solids.

The Scope of the Invention

Further still, the embodiments shown and described in detail herein are provided by way of example only; and the scope of the invention is not intended to be limited to the particular configurations, dimensionalities, and/or design details of these parts or elements included herein. In other words, a person skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What is claimed is:

1. A dual diaphragm pump (10), comprising:

upper and lower diaphragm pumping assemblies (12, 14) having diaphragms (12, 14*a*) and upper and lower inlet manifold conduits in fluidic communication with upper and lower outlet manifold conduits;

a combination of a motor (13) and a shaft/diaphragm actuator assembly (15) coupled to the upper and lower diaphragm pumping assemblies (12, 14) and together with the diaphragms (12*a*, 14*a*) in order to provide a liquid from the upper and lower inlet manifold conduits to the upper and lower outlet manifold conduits; and a manifold assembly (20) arranged between the upper and lower inlet manifold conduits and the upper and lower outlet manifold conduits of the upper and lower diaphragm pumping assemblies (12, 14), the upper and lower diaphragm pumping assemblies (12, 14) configured to pump a particle medium having solids and particulates with up to four millimeters in diameter through the manifold assembly (20) without fouling or clogging, the manifold assembly (20) having a manifold body that is a plastic injection molded integral structure and includes:

an inlet having at least one inlet port (20*a*(1), 20*a*(2)) and an inlet chamber (20*a*) configured to receive the particle medium from at least one fluid source, an inlet check valve assembly channel (20*d*) formed therein and being in fluidic communication with the inlet chamber (20*a*) and both the upper and lower inlet manifold conduits of the upper and lower diaphragm pumping assemblies (12, 14), an inlet duckbill check valve assembly having two input duckbill check valves (30, 32) arranged in the inlet check valve assembly channel (20*d*), each input duckbill check valve configured to allow the particle medium to pass from the inlet chamber (20*a*), through the inlet check valve assembly channel (20*d*), to a respective one of the upper and lower inlet manifold conduits of the upper and lower diaphragm pumping assemblies (12, 14), an outlet check valve assembly channel (20*e*) formed therein and being in fluidic communication with both the upper and lower outlet manifold conduits of the upper and lower diaphragm pumping assemblies (12,14), an outlet duckbill check valve assembly having two output duckbill check valves (40, 42) arranged in the outlet check valve assembly channel (20*e*), each output duckbill check valve configured to allow the particle medium to pass from the respective one of the upper and lower outlet manifold conduits of the upper and lower diaphragm pumping assemblies (12, 14) and to the outlet check valve assembly channel (20*e*), and an outlet having an outlet chamber (20*b*) and at least one outlet port (20*b*(1), 20*b*(2)), the outlet chamber (20*b*) being in fluidic communication with the outlet check valve assembly channel (20*e*), and configured to allow the particle medium to pass from the outlet check valve assembly channel (20*e*), through the outlet chamber (20*b*), to the at least one outlet port (20*b*(1), 20*b*(2)) for providing to at least one fluid outlet source, wherein the at least one outlet port comprises a plurality of outlet ports, wherein each of the plurality of outlet ports is configured to slidably receive one of: a first port fitting connection that allows passage of fluid either to or from a corresponding one of the plurality of outlet ports, and a second port fitting connection that does not allow passage of fluid to or from the corresponding one of the plurality of outlet ports.

2. A dual diaphragm pump (10) according to claim 1, wherein the at least one inlet port (20*a*(1), 20*a*(2)) comprises dual inlet ports (20*a*(1), 20*a*(2)) configured to receive inlet port fitting connections.

3. A dual diaphragm pump (10) according to claim 2, wherein the dual inlet ports (20*a*(1), 20*a*(2)) are configured or oriented orthogonal to one another; and the plurality of outlet ports (20*b*(1), 20*b*(2)) are configured or oriented orthogonal to one another.

4. A dual diaphragm pump (10) according to claim 2, wherein the dual inlet ports (20*a*(1), 20*a*(2)) and the inlet chamber (20*a*) are configured to receive the particle medium from two fluid sources for mixing together in the inlet chamber (20*a*); and the plurality of outlet ports (20*b*(1), 20*b*(2)) and the outlet chamber (20*b*) are configured to provide a mixed fluid to the at least one fluid outlet source.

5. A dual diaphragm pump (10) according to claim 2, wherein either the dual inlet ports (20*a*(1), 20*a*(2)), or the plurality of outlet ports (20*b*(1), 20*b*(2)), or both the dual inlet ports (20*a*(I), 20*a*(2)) and the plurality of outlet ports (20*b*(I), 20*b*(2)) are configured to receive different port fitting connections.

6. A dual diaphragm pump (10) according to claim 1, wherein the manifold assembly (20) comprises two manifold assembly plates (12*b*, 14*b*) attached to upper and lower surfaces of the manifold body and configured with the upper and lower inlet manifold conduits and the upper and lower outlet manifold conduits.

7. A dual diaphragm pump (10) according to claim 1, wherein the two input duckbill check valves (30, 32) include an upper input duckbill check valve configured to provide the particle medium from the inlet check valve assembly channel (20*d*) to an upper inlet manifold conduit of an upper diaphragm pumping assembly, and include a lower input duckbill check valve configured to provide the particle medium from the inlet check valve assembly channel (20*d*) to a lower inlet manifold conduit of a lower diaphragm pumping assembly; and the two output duckbill check valves (40, 42) include an upper output duckbill check valve configured to provide the particle medium from an upper outlet manifold conduit of the upper diaphragm pumping assembly via the outlet check valve assembly channel (20*e*) to the outlet chamber (20*b*), and include a lower output duckbill check valve configured to provide the particle medium from a lower outlet manifold conduit of the lower diaphragm pumping assembly via the outlet check valve assembly channel (20*e*) to the outlet chamber (20*b*).

8. A dual diaphragm pump (10) according to claim 1, wherein the at least one inlet port comprises a plurality of inlet ports;

the plurality of inlet ports are configured or oriented orthogonal to one another, and the plurality of outlet ports are configured or oriented orthogonal to one another; and the directions of orientations of the plurality of inlet ports and corresponding directions of the plurality of outlet ports extend in a common plane.

* * * * *